US006030294A

United States Patent [19]

Shira

[11] Patent Number: 6,030,294

[45] **Date of Patent: *Feb. 29, 2000**

[54] GOLF CLUB WITH POROUS STRIKING SURFACE AND ITS METHOD OF MANUFACTURE

[75] Inventor: Chester S. Shira, San Diego, Calif.

[73] Assignee: Carbite, Inc., San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,545

[22] Filed: Apr. 22, 1997

[51] Int. Cl.[7] ..... A63B 53/04

[52] U.S. Cl. ..... 473/342; 473/349

[58] Field of Search ..... 473/342, 348, 473/349, 324

[56] References Cited

U.S. PATENT DOCUMENTS

| | | | |
|---|---|---|---|
| 3,218,072 | 11/1965 | Burr . | |
| 3,695,618 | 10/1972 | Wooley . | |
| 3,897,221 | 7/1975 | Slayer | 428/566 |
| 3,900,940 | 8/1975 | Gebhard | 419/27 |
| 4,076,254 | 2/1978 | Nygren . | |
| 4,122,143 | 10/1978 | Momotari | 264/104 |
| 4,504,520 | 3/1985 | Kurahashi | 427/499 |
| 4,687,205 | 8/1987 | Tominaga et al. . | |
| 4,730,830 | 3/1988 | Tilley | 473/337 |
| 4,740,345 | 4/1988 | Nagasaki | 264/257 |
| 4,768,787 | 9/1988 | Shira | 473/331 |
| 4,833,040 | 5/1989 | Fishman | 428/570 |
| 4,992,236 | 2/1991 | Shira | 419/28 |
| 5,016,883 | 5/1991 | Kobayashi . | |
| 5,094,810 | 3/1992 | Shira | 419/6 |
| 5,154,425 | 10/1992 | Niskanen et al. . | |
| 5,342,812 | 8/1994 | Niskanen et al. | 501/127 |
| 5,390,922 | 2/1995 | Cornish | 473/317 |
| 5,425,538 | 6/1995 | Vincent et al. . | |
| 5,524,331 | 6/1996 | Pond | 29/527.4 |
| 5,625,861 | 4/1997 | Nishi | 419/2 |
| 5,647,808 | 7/1997 | Hosokawa | 473/349 |
| 5,705,118 | 1/1998 | Hayes | 264/656 |

FOREIGN PATENT DOCUMENTS

| | | |
|---|---|---|
| 53-51110 | 5/1978 | Japan . |

*Primary Examiner*—Jeanette Chapman
*Assistant Examiner*—Stephen L. Blau
*Attorney, Agent, or Firm*—John L. Gray, Esq.; Kegler, Brown Hill & Ritter Co., L.P.A.

[57] ABSTRACT

A method of making a golf club head or an insert for a golf club head and the product produced thereby which comprises preparing a porous base selected from the group consisting of metals, metal alloys, and cermets, and coating at least the face of said base with a plastic material.

4 Claims, 1 Drawing Sheet

GOLF CLUB WITH POROUS STRIKING SURFACE AND ITS METHOD OF MANUFACTURE

BACKGROUND OF THE INVENTION

Golf club heads have been modified in a great variety of ways to improve certain characteristics of the club. This has often been done by providing inserts in the ball striking surface of the club head, but in some instances has been accomplished by modifying the entire club head.

In some instances, composite materials have been used to accomplish this objective. An example of this is the high friction inserts introduced by Carbite, Inc. in 1991 and in U.S. Pat. No. 5,154,425, Niskanen, et al., which discloses metal matrix composites and/or ceramic matrix composite materials where the golf club head or the insert in the ball striking face includes a solid mixture of various materials.

BRIEF SUMMARY OF THE INVENTION

Applicant has found that by making either the club head or an insert to be placed in the ball striking face of the club head out of a porous material and then coating the exposed porosity portion of the club head of the insert with another material, a number of beneficial results may be achieved. By using such a structure, the modulus of elasticity and the mechanical properties along with porosity levels of the base material can be varied within a set of golf clubs and designed specifically for the type of club whether it be a putter, an iron, a metal wood, or a utility club. By doing this the feel, impact, and rebound effects may be modified.

The particular club head is then sealed with an appropriate material such as elastomers, polymers, epoxies, and the like; hereinafter, collectively referred to as plastics, to prevent the intrusion of moisture, debris, bacteria, mold, and the like during use. No one fully dense, or near fully dense insert material, alloy, or composite could provide the combined advantages of controlled friction, desired feel, distance control, and vibration absorption desired.

It is therefore an object of this invention to provide a golf club having controlled friction on the golf ball striking surface, desired feel and sound when striking a golf ball, a controlled rebound effect when striking a golf ball and, thus, have a multiplicity of performance benefits and also provide a low cost striking surface for advanced golf clubs.

It is a further object of this invention to provide inserts for golf clubs having the same advantages set forth above.

These, together with other objects of the invention, will become apparent from the following detailed description of the invention and the accompanying drawings.

DETAILED DESCRIPTION OF THE INVENTION

While this invention has been shown and described with respect to inserts for golf club heads, it should be understood that entire golf club heads may be made in accordance with this invention.

Figure 1:
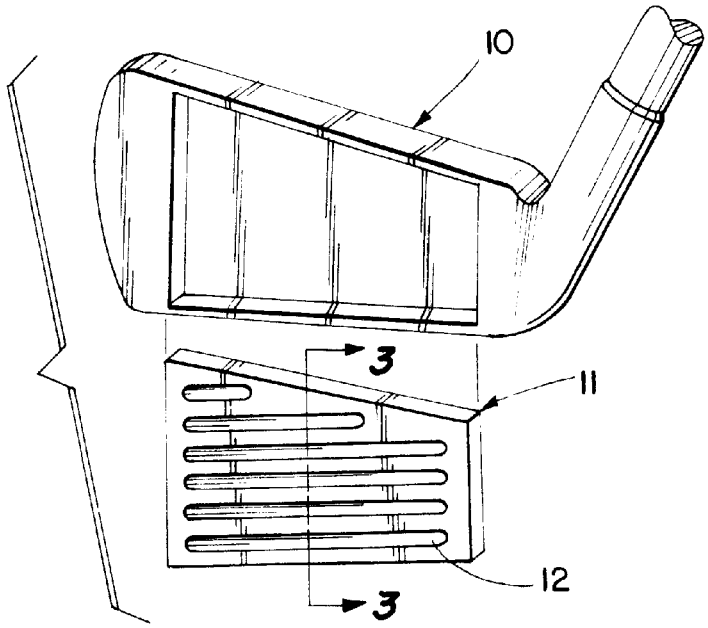
FIG. 1 is an iron-type golf club showing an insert embodying this invention which may be inserted into the golf club head.

Referring now to FIG. 1, there is shown a typical iron-type golf club head 10 and insert 11 therefore provided with a grooved surface 12.

Figure 2:
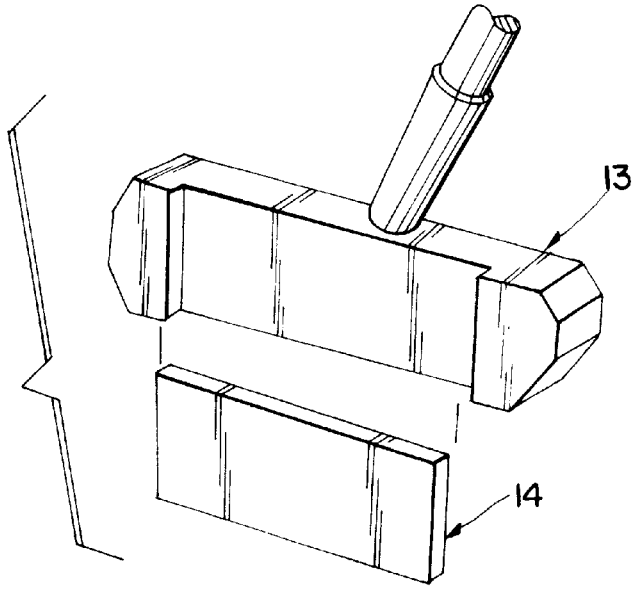
FIG. 2 is a putter showing an insert having the advantages of this invention which may be attached to the putter.

FIG. 2 shows a putter 13 with an insert 14.

Figure 3:
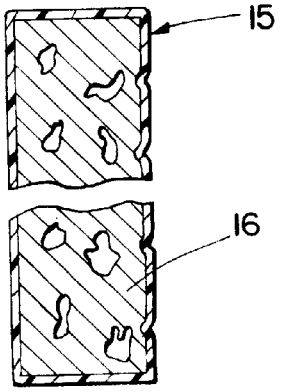
FIG. 3 is an enlarged section on the plane 3—3 through the insert of FIG. 1 showing the interior construction of the insert which would be also the same as the interior construction of a golf club head if the entire head where manufactured in accordance with Applicant's invention.

Referring now to FIG. 3, there is shown a section of the insert 11 of FIG. 1 which has been coated with an appropriate plastic material 15 and which shows the porous nature of the base material 16. As shown, the face, top, bottom, and back of the insert 11 have been coated with plastic material 15. Alternatively, only the face, or the face, top and bottom of the insert may be so coated.

In making an insert or an entire golf club head, a method to be followed is to fill a mold with non-spherical matrix powders, the size having been determined by the desired density of the design. The matrix powders may be metals, metal alloys, or cermets. Pressure is then applied adequate to bond the powders. The resultant compact is then removed from the mold and sintered at a temperature adequate to achieve proper matrix strength of the base material and create the desired matrix density. The range of desired densities can be defined at 40% of theoretical to 95% of theoretical density. Thereafter, the sintered body may be coated with a plastic material such as monomers, polymers, urethanes, polyurethanes, epoxies, lacquers, paints, and the like, as well as the same materials containing finely divided particles of any of the large assortment of commonly used fillers. Alternatively, instead of using matrix powders, fibers may be used. This would involve the use of pressure to pre-form the fibers in the desired shape into the desired pre-sintered density. After pre-forming, the sintering and coating process would be essentially the same.

The base materials include soft metal or alloy powder and fibers such as aluminum copper and nickel; hard metal powders such as tool steels and precipitation hardening stainless steels; light metal powders such as aluminum, titanium, and beryllium; and composite metal powders, such as aluminum, boride, boron, carbide, and cermets such as aluminum with silicon carbide or other carbides, nitrides, or oxides and titanium aluminides. The choice of these will enable fabrication of club heads or inserts to satisfy specific golfing application needs.

By choosing particular matrix base materials and base density and using coating materials of choice one can provide an infinite number of characteristics appropriate for application as golf club heads or as inserts for golf clubs.

With respect to a putter such as shown in FIG. 2, the primary needs for a putter insert are specific rebound effect, vibration absorption, and dampening, a specific coefficient of friction, a specific natural frequency of the putter head and assembly, a low frequency audible sound when striking the ball, and little energy transmitted up the shaft when striking a ball off center. Set forth below is an example of an insert for putters.

EXAMPLE 1

An Insert for Putters

The matrix is made of a bronze alloy containing 8% nickel, 4% tin, and the balance copper. The metal is in the form of 46 to 100 mesh powder which is blended with a binding/lubricating agent and placed in a closed insert-shaped die and pressed at approximately 5,000 psi to form a green compact. The green compact is removed from the die and sintered in a reducing atmosphere at 1730° F. for one hour. The resultant matrix is now approximately 75% of theoretical density. Thereafter, polyurethane is coated on the surface of the insert. If desired, the ball striking surface can be ground or machined to produce a desired finish. The insert may then be installed in the club face by any of or a combination of usual and accepted practices in use today.

Unlike the putters that are produced without grooves or patterns on the hitting surface, inserts for irons or the entire iron club head are generally produced with grooves on the striking surface and would also require the use of materials highly resistant to abrasion and impact. Primary benefits are to increase hitting distance to improve ball control by varying the coefficient of friction to enhance back spin, minimize side spin, and vary the coefficient of restitution for distance control.

EXAMPLE 2

An Insert for Irons

The matrix is made of a high strength, heat treatable bronze alloy containing 15% nickel, 8% tin, and the balance copper. The metal is in the form of nominally 100 mesh powder blended with a binder/lubricating agent. The powder is placed into a shaped die and pressed at approximately 5,000 psi to form a green compact. The press die creates the desired groove pattern in the compact at the same time the pressing is accomplished. The resultant green compact is sintered at 1730° F. for one hour resulting in an insert matrix of approximately 75% of theoretical density. The insert is then coated with a high-friction coefficient, two phase version of epoxy to provide a desired coating over the entire surface of the base material. The insert face may be finished by grinding or machining if desired. The insert is then installed in the club face by any or a combination of the usual and accepted practices in use today. This produces an insert with a soft feel, high friction characteristics, and high rebound effects.

EXAMPLE 3

An Insert for Irons

A lightweight insert may be desired to create high moments of inertia in iron heads by permitting movement of weight from the center section of the club. In this case, the matrix might be titanium aluminide powder in the form of 46–100 mesh powder, placed in a closed die and pressed at 5,000–10,000 psi, removed and vacuum sintered at 2100° F. for one hour to achieve a density approximately 75% of theoretical density. The matrix insert is then coated with a polyurethane with a hardness designed to enable proper deformation during impact with the ball to enable the titanium aluminide to impart high friction to the ball. The combination of matrix and coating will be selected to provide the desired effect.

Metal woods may be produced with or without grooves and patterns on the hitting surface. The primary needs are to provide a high coefficient of restitution for increased distance, and provide desired lubricity of the base and coatings to minimize side spin. Feel is measured by sound volume and frequency and vibration dampening and may be adjusted by judicious materials selected to meet the perceived needs of golfers of differing skill levels.

EXAMPLE 4

An Insert for Metal Woods

A lightweight insert is made using 100 mesh titanium powder pressed in a closed die at 10,000 psi and sintered at 2150° F. for one hour to a density of 80% of theoretical density. The part is then coated with a polyurethane of suitable durometer hardness, coefficient of friction, and high rebound coefficient. Horizontal grooves are used to gain reproducible back spin and control ball trajectory. The low friction coefficient of the coating will minimize side spin to improve accuracy and the high rebound coefficient will increase distance.

While this invention has been shown and described with respect to a detailed embodiment thereof, it will be understood by those skilled in the art that various changes in form and detail thereof may be made without departing from the scope of the claims of the invention.

What is claimed is:

1. A golf club head comprising:

a compressed, sintered porous base having been prepared from non-spherical powders, the particle size of said powders having been determined by the degree of porosity desired in order to achieve the mechanical properties desired in said base, which mechanical properties in turn have been determined by the desired characteristics of the golf club head being made, said powders having been selected from the group consisting of metals, metal alloys, and cermets, said base having been sintered at a suitable temperature and a suitable length of time in order to achieve said selected degree of porosity so as to provide the mechanical properties desired in said base dependent upon the desired characteristics of the golf club head being made, and at least the face of said base being coated with a plastic material.

2. An insert for the face of a golf club head comprising:

a compressed, sintered porous insert having been prepared from non-spherical powders, the particle size of said powders having been determined by the degree of porosity desired in order to achieve the mechanical properties desired in said insert, which mechanical properties in turn have been determined by the desired characteristics of the golf club head which will receive said insert, said powders being selected from the group consisting of metals, metal alloys, and cermets, said insert having been sintered at a suitable temperature and a suitable length of time in order to achieve said selected degree of porosity so as to provide the mechanical properties desired in said insert dependent on the desired characteristics of the golf club head which will receive said insert, and at least the face of said insert having been coated with a plastic material.

3. A method of making a golf club head comprising:

determining the desired degree of porosity in said golf club head to achieve the desired mechanical properties in said gold club head which mechanical properties in turn have been determined by the desired characteristics of said golf club head, selecting non-spherical powders of a particle size which when sintered and compressed will produce a golf club head having said desired degree of porosity, said powders being selected from the group of metals, metal alloys and cermets, compressing said golf club head to a desired density, selecting a suitable temperature and a suitable length of time for sintering said compressed golf club head in order to achieve said selected degree of porosity so as to provide the mechanical properties desired in said golf club head depending on the desired characteristics of said golf club head being made, thereafter sintering said compressed golf club head at said selected temperature and said selected length of time, coating at least the face of said golf club head with a plastic material in liquid form, and thereafter curing and solidifying said plastic coating.

4. A method of making an insert for the face of a golf club head comprising:

determining the desired degree of porosity in said insert to achieve the desired mechanical properties in said insert which mechanical properties in turn have been determined by the desired characteristics of the golf club head which will receive said insert, selecting non-spherical powders of a particle size which when sintered and compressed will produce a porous insert having said desired degree of porosity, said powders being selected from the group of metals, metal alloys and cermets, compressing said insert to a desired density, selecting a suitable temperature and a suitable length of time for sintering said compressed insert in order to achieve said selected degree of porosity so as to provide the mechanical properties desired in said insert dependent upon the desired characteristics of the golf club head which will receive said insert, thereafter sintering said compressed insert at said selected temperature and selected length of time, coating at least the face of said insert with a plastic material in liquid form, and thereafter curing and solidifying said plastic coating.

* * * * *